US009323262B2

(12) United States Patent
Tomioka

(10) Patent No.: US 9,323,262 B2
(45) Date of Patent: Apr. 26, 2016

(54) VOLTAGE REGULATOR

(71) Applicant: Seiko Instruments Inc., Chiba-shi, Chiba (JP)

(72) Inventor: Tsutomu Tomioka, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 0 days.

(21) Appl. No.: 14/599,158

(22) Filed: Jan. 16, 2015

(65) Prior Publication Data

US 2015/0205315 A1 Jul. 23, 2015

(30) Foreign Application Priority Data

Jan. 22, 2014 (JP) ..... 2014-009643

(51) Int. Cl.
*G05F 1/56* (2006.01)
*G05F 1/575* (2006.01)
*G05F 1/573* (2006.01)

(52) U.S. Cl.
CPC . *G05F 1/56* (2013.01); *G05F 1/573* (2013.01); *G05F 1/575* (2013.01)

(58) Field of Classification Search
USPC ..... 323/271–285; 327/538–543
See application file for complete search history.

(56) References Cited

U.S. PATENT DOCUMENTS

| | | | | |
|---|---|---|---|---|
| 4,553,082 | A * | 11/1985 | Nesler | 323/288 |
| 8,324,876 | B1 * | 12/2012 | Le et al. | 323/273 |
| 2003/0214275 | A1 * | 11/2003 | Biagi | G05F 1/575 323/280 |
| 2006/0279269 | A1 * | 12/2006 | Yang | 323/313 |
| 2012/0155127 | A1 * | 6/2012 | Brokaw | 363/49 |
| 2013/0015888 | A1 * | 1/2013 | Chan | H02M 1/36 327/109 |
| 2014/0002051 | A1 * | 1/2014 | Grimm et al. | 323/311 |

FOREIGN PATENT DOCUMENTS

JP 2009-187430 A 8/2009

* cited by examiner

*Primary Examiner* — Timothy J Dole
*Assistant Examiner* — Bryan R Perez
(74) *Attorney, Agent, or Firm* — Brinks Gilson & Lione

(57) ABSTRACT

Provided is a voltage regulator capable of preventing breakdown of a gate of an input transistor even when an overshoot occurs at an output terminal. The voltage regulator includes a diode, which is provided to an input transistor to which a divided voltage of an error amplifier circuit is input. The diode includes a cathode connected to a source of the input transistor and an anode connected to a gate thereof.

1 Claim, 3 Drawing Sheets

VOLTAGE REGULATOR

RELATED APPLICATIONS

This application claims priority under 35 U.S.C. §119 to Japanese Patent Application No. 2014-009643 filed on Jan. 22, 2014, the entire content of which is hereby incorporated by reference.

BACKGROUND OF THE INVENTION

1. Field of the Invention

The present invention relates to a voltage regulator capable of preventing breakdown of an input transistor of an error amplifier circuit when an overshoot occurs at its output.

2. Description of the Related Art

A related-art voltage regulator is now described. FIG. 3 is a circuit diagram illustrating the related-art voltage regulator.

The related-art voltage regulator includes PMOS transistors 104, 105, 106, 109, 111, 114, 115, and 301, NMOS transistors 107, 108, 112, 113, 302, and 303, a reference voltage circuit 110, a constant current circuit 103, resistors 116 and 117, a ground terminal 100, an output terminal 102, and a power supply terminal 101. It is assumed that the size of the PMOS transistor 301 is 0.2 time as large as that of the PMOS transistor 105.

When an overshoot occurs at the output terminal 102, a voltage generated at a gate of the PMOS transistor 111 becomes significantly larger than a reference voltage Vref of the reference voltage circuit 110, which is supplied to a gate of the PMOS transistor 109. When a large overshoot occurs at the output terminal 102, a value of a current flowing through the PMOS transistor 109 usually becomes substantially the same as that of a current of the PMOS transistor 105. A value of a current flowing through the PMOS transistor 111 therefore becomes an extremely small value, which is close to zero. At this time, the NMOS transistor 302 can cause only an extremely small amount of current to flow, and hence the PMOS transistor 301 attempts to cause a current whose value is 0.2 time as large as that of the current of the PMOS transistor 105 to flow.

Then, in turn, a value of a current flowing through the PMOS transistor 301 and the NMOS transistor 302 connected in series becomes extremely small. A drain-source voltage of the PMOS transistor 301 then becomes small, and a voltage at a common connection point of a main current path of the PMOS transistor 301 and the NMOS transistor 302 becomes larger. The NMOS transistor 303 is accordingly brought into an ON state. When the NMOS transistor 303 is brought into the ON state, a current flows from the output terminal 102 toward the ground terminal 100 via the NMOS transistor 303, which exerts an effect of reducing the output voltage as a result (see, for example, FIG. 2 of Japanese Patent Application Laid-open No. 2009-187430).

However, the related-art voltage regulator has a problem in that, when the overshoot occurs at the output terminal 102, a gate voltage of the PMOS transistor 111 also increases accordingly, and hence the gate of the PMOS transistor 111 is broken down.

SUMMARY OF THE INVENTION

The present invention has been made in view of the above-mentioned problem, and provides a voltage regulator capable of preventing breakdown of a gate of an input transistor even when an overshoot occurs at an output terminal.

In order to solve the related-art problem, a voltage regulator according to one embodiment of the present invention has the following configuration.

The voltage regulator includes: an error amplifier circuit configured to amplify a difference between a divided voltage obtained by dividing an output voltage output from an output transistor and a reference voltage output from a reference voltage circuit to output the amplified difference, thereby controlling a gate of the output transistor; and a diode, which is provided to an input transistor to which the divided voltage of the error amplifier circuit is input. The diode includes a cathode connected to a source of the input transistor and an anode connected to a gate thereof.

The voltage regulator according to one embodiment of the present invention includes the diode, which is provided to the input transistor to which the divided voltage of the error amplifier circuit is input. The diode includes the cathode connected to the source of the input transistor and the anode connected to the gate thereof. It is therefore possible to prevent the breakdown of the gate of the input transistor even when the overshoot occurs at the output terminal. It is further possible to make the return of the operating point of the entire error amplifier circuit earlier even when the power supply voltage drops temporarily.

DETAILED DESCRIPTION OF THE PREFERRED EMBODIMENT

Figure 1:
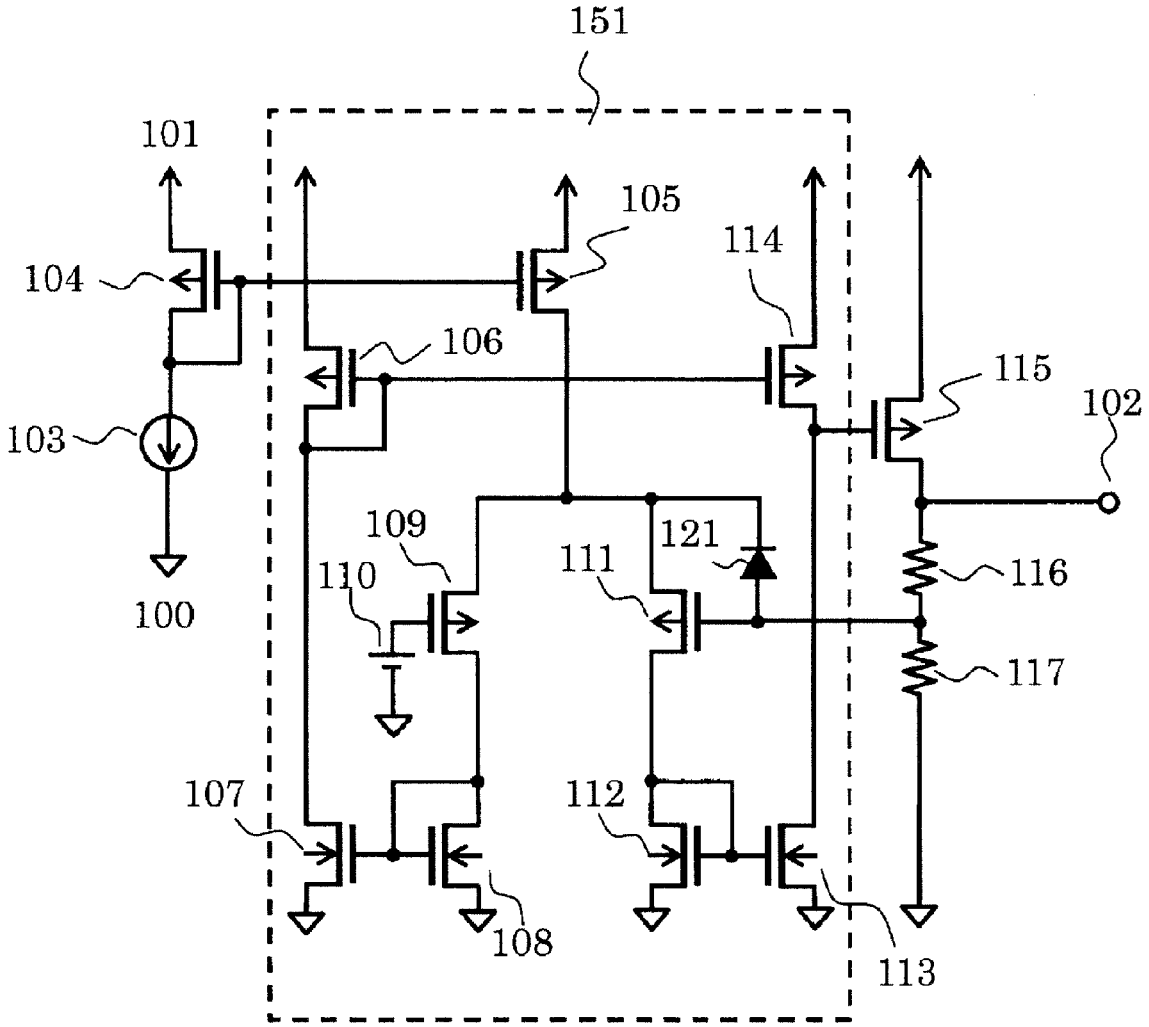
FIG. 1 is a circuit diagram illustrating a configuration of a voltage regulator according to an embodiment of the present invention.

FIG. 1 is a circuit diagram of a voltage regulator according to an embodiment of the present invention.

The voltage regulator according to this embodiment includes PMOS transistors 104, 105, 106, 109, 111, 114, and 115, NMOS transistors 107, 108, 112, and 113, a reference voltage circuit 110, a constant current circuit 103, resistors 116 and 117, a diode 121, a ground terminal 100, an output terminal 102, and a power supply terminal 101. The PMOS transistors 105, 106, 109, 111, and 114 and the NMOS transistors 107, 108, 112, and 113 form an error amplifier circuit 151.

Next, connections in the voltage regulator according to this embodiment are described.

The constant current circuit 103 has one terminal connected to a gate and a drain of the PMOS transistor 104 and the other terminal connected to the ground terminal 100. The PMOS transistor 104 has a source connected to the power supply terminal 101. The PMOS transistor 105 has a gate connected to the gate and the drain of the PMOS transistor 104, a drain connected to a source of the PMOS transistor 109 and a source of the PMOS transistor 111, and a source connected to the power supply terminal 101. The PMOS transistor 109 has a gate connected to a positive electrode of the reference voltage circuit 110 and a drain connected to a gate and a drain of the NMOS transistor 108. The reference voltage circuit 110 has a negative electrode connected to the ground terminal 100. The NMOS transistor 108 has a source connected to the ground terminal 100. The NMOS transistor 107 has a gate connected to the gate and the drain of the NMOS transistor 108, a drain connected to a gate and a drain of the PMOS transistor 106, and a source connected to the ground terminal 100. The PMOS transistor 106 has a source connected to the power supply terminal 101. The PMOS transistor 114 has a gate connected to the gate and the drain of the PMOS transistor 106, a drain connected to a gate of the PMOS transistor 115, and a source connected to the power supply terminal 101. The NMOS transistor 113 has a gate connected to a gate and a drain of the NMOS transistor 112, a drain connected to the gate of the PMOS transistor 115, and a source connected to the ground terminal 100. The NMOS transistor 112 has a source connected to the ground terminal 100. The PMOS transistor 111 has a drain connected to the gate and the drain of the NMOS transistor 112 and a gate connected to a connection point between one terminal of the resistor 116 and one terminal of the resistor 117. The resistor 117 has the other terminal connected to the ground terminal 100, and the resistor 116 has the other terminal connected to the output terminal 102. The diode 121 has a cathode connected to the source of the PMOS transistor 111 and an anode connected to the gate of the PMOS transistor 111. The PMOS transistor 115 has a drain connected to the output terminal 102 and a source connected to the power supply terminal 101.

Next, an operation of the voltage regulator according to this embodiment is described.

When a power supply voltage VDD is input to the power supply terminal 101, the voltage regulator outputs an output voltage Vout from the output terminal 102. The resistors 116 and 117 divide the output voltage Vout and output a divided voltage Vfb. The error amplifier circuit 151 compares a reference voltage Vref of the reference voltage circuit 110 input to the gate of the PMOS transistor 109 operating as an input transistor and the divided voltage Vfb input to the gate of the PMOS transistor 111 operating as an input transistor with each other, thereby controlling a gate voltage of the PMOS transistor 115 operating as an output transistor so that the output voltage Vout is constant.

When the output voltage Vout is larger than a predetermined voltage, the divided voltage Vfb is larger than the reference voltage Vref. Hence, an output signal of the error amplifier circuit 151 (the gate voltage of the PMOS transistor 115) is increased, and the PMOS transistor 115 is turned off to reduce the output voltage Vout. In addition, when the output voltage Vout is smaller than the predetermined voltage, operations opposite to the above-mentioned operations are performed to increase the output voltage Vout. In this way, the voltage regulator operates so that the output voltage Vout is constant.

When an overshoot occurs at the output terminal 102, the divided voltage Vfb also increases along with an increase in the output voltage Vout, and a current flows through a path including the diode 121, the PMOS transistor 109, the NMOS transistor 108, and the ground terminal 100. The divided voltage Vfb is therefore limited to a voltage of $Vfb=Vref+|Vtp|+Vf$ or less. In this case, a threshold of the PMOS transistors 109 and 111 is represented by Vtp, a threshold of the NMOS transistor 112 is represented by Vtn, and a forward voltage of the diode 121 is represented by Vf.

At this time, a gate-source voltage of the PMOS transistor 111 becomes equal to the forward voltage Vf of the diode 121, and hence it is possible to prevent breakdown of the gate of the PMOS transistor 111. Further, a gate-drain voltage of the PMOS transistor 111 becomes $Vfb-Vtn=Vref+|Vtp|+Vf-Vtn$. By setting this gate-drain voltage to a voltage smaller than a withstand voltage of a gate oxide film of the PMOS transistor 111, it is possible to prevent the breakdown of the gate of the PMOS transistor 111.

Note that, it is only necessary to provide the diode 121 between the gate and the source of the PMOS transistor 111, and hence the voltage regulator according to this embodiment requires only a small area therefor. Further, a leakage current from the diode 121 to the resistor 117 is small, and hence an influence of the leakage current on the value of the divided voltage Vfb is also small. Still further, when the power supply voltage VDD drops temporarily and a source voltage of the PMOS transistor 111 drops accordingly, the diode 121 causes the forward current to flow to prevent the source voltage of the PMOS transistor 111 from dropping, and hence it is possible to make return of an operating point of the entire error amplifier circuit 151 earlier.

Figure 2:
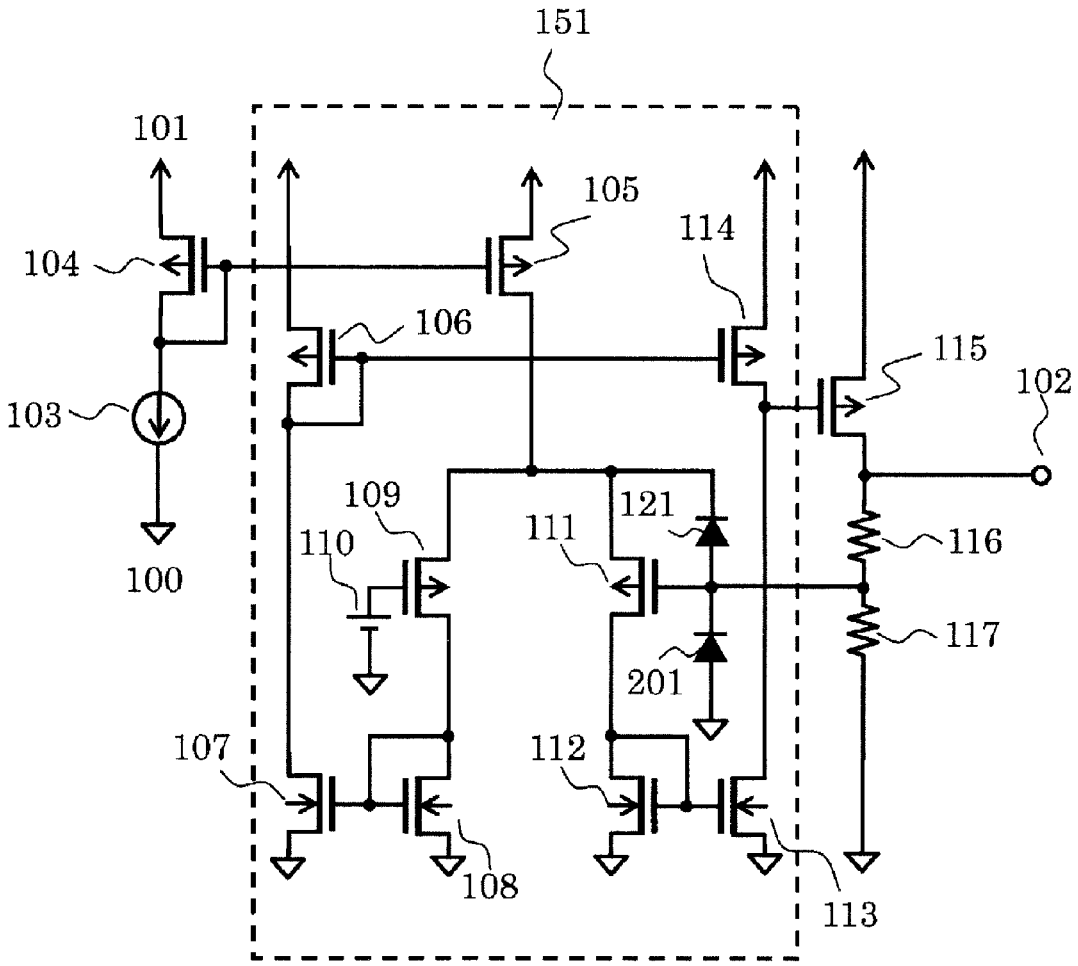
FIG. 2 is a circuit diagram illustrating another example of the configuration of the voltage regulator according to the embodiment of the present invention.
Figure 3:
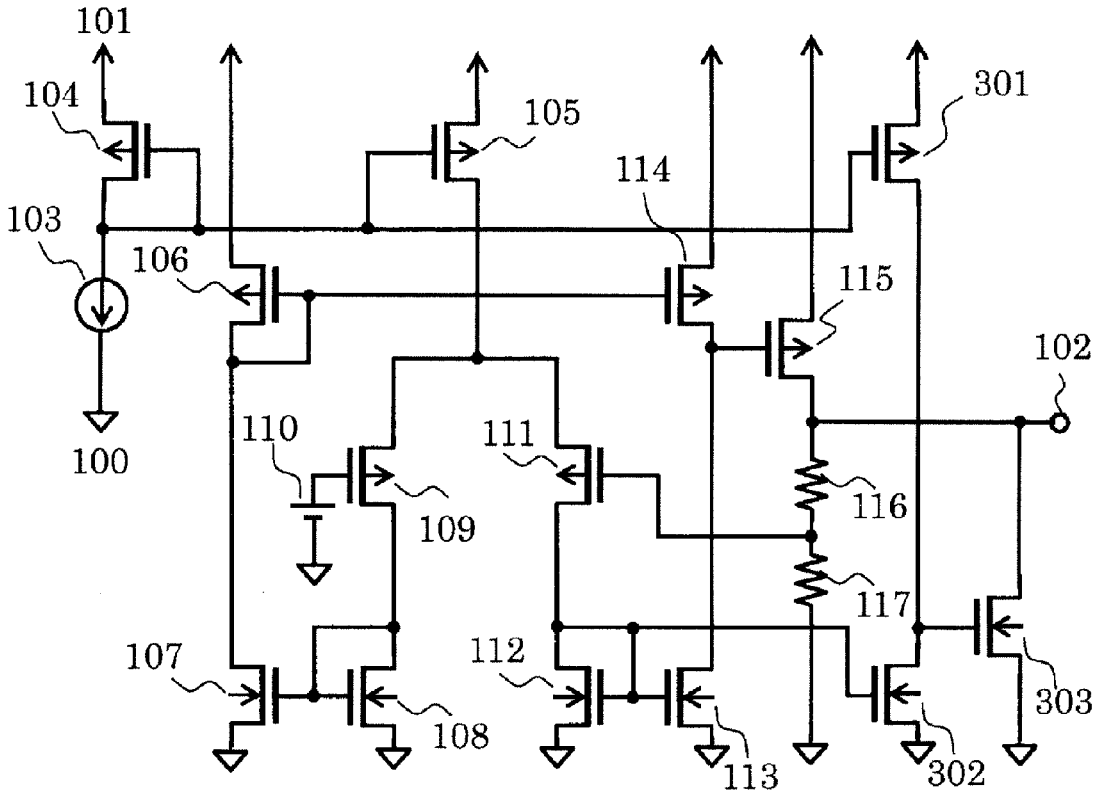
FIG. 3 PRIOR ART
FIG. 3 is a circuit diagram illustrating a configuration of a related-art voltage regulator.

FIG. 2 is a circuit diagram illustrating another example of the configuration of the voltage regulator according to this embodiment. The voltage regulator of this example differs from that of FIG. 1 in that a diode 201 is added. The diode 201 has a cathode connected to the gate of the PMOS transistor 111 and an anode connected to the ground terminal 100. The rest of the circuit configuration is the same as that of the voltage regulator of FIG. 1.

The diode 201 has the same configuration as that of the diode 121, and hence the same leakage current flows. When a leakage current is generated at the diode 121, the leakage current flows through the diode 201 and does not flow through the resistor 117. It is therefore possible to further reduce the influence of the leakage current on the value of the divided voltage Vfb as compared with the voltage regulator of FIG. 1.

As described above, the voltage regulator according to this embodiment includes the diode 121 between the gate and the source of the PMOS transistor 111. Accordingly, even when the overshoot occurs at the output terminal 102, the withstand voltage of the gate oxide film of the PMOS transistor 111 is not exceeded, and hence it is possible to prevent the breakdown of the gate of the PMOS transistor 111.

Further, when the power supply voltage VDD drops temporarily, it is possible to make the return of the operating point of the entire error amplifier circuit 151 earlier.

What is claimed is:

1. A voltage regulator comprising an error amplifier circuit configured to amplify a difference between a divided voltage obtained by dividing an output voltage output from an output transistor and a reference voltage output from a reference voltage circuit to output the amplified difference, thereby controlling a gate of the output transistor, the error amplifier circuit comprising:

a first transistor that is part of a current mirror circuit, the first transistor having a drain;

an input transistor having a source that is coupled to the drain of the first transistor and a gate to which the divided voltage is input;

a first diode including a cathode connected to the drain of the first transistor and an anode connected to a gate of the input transistor, wherein the first diode protects the gate of the input transistor when an overshoot occurs in the output voltage;

a second diode including a cathode connected to the gate of the input transistor and an anode connected to a ground terminal, wherein the second diode causes a leakage current of the first diode to flow, thereby reducing an influence of the leakage current of the first diode on the divided voltage, wherein the second diode is of a same configuration as the first diode such that the first and second diodes have matching leakages, wherein the second diode compensates for the leakage caused by the first diode.

* * * * *